US009666080B2

(12) United States Patent
Shanbhag et al.

(10) Patent No.: US 9,666,080 B2
(45) Date of Patent: May 30, 2017

(54) SYSTEMS AND METHODS FOR DISPLAYING DEGRADED INTRUDER TRAFFIC DATA ON AN AIRCRAFT DISPLAY

(71) Applicant: HONEYWELL INTERNATIONAL INC., Morristown, NJ (US)

(72) Inventors: Vasudev Prakash Shanbhag, Karnataka (IN); Sridhar Krishna, Karnataka (IN); Sanjib Kumar Maji, Karnataka (IN); Shashi Kiran Ravikumar, Karnataka (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 393 days.

(21) Appl. No.: 14/327,247

(22) Filed: Jul. 9, 2014

(65) Prior Publication Data

US 2016/0012732 A1 Jan. 14, 2016

(51) Int. Cl.
*G08G 5/00* (2006.01)
*G08G 5/04* (2006.01)

(52) U.S. Cl.
CPC ..... *G08G 5/0008* (2013.01); *G08G 5/0021* (2013.01); *G08G 5/0052* (2013.01); *G08G 5/0078* (2013.01); *G08G 5/0056* (2013.01); *G08G 5/045* (2013.01)

(58) Field of Classification Search
CPC combination set(s) only.
See application file for complete search history.

(56) References Cited

U.S. PATENT DOCUMENTS 5,872,526 A 2/1999 Tognazzini
5,892,462 A * 4/1999 Tran ..... G01C 5/005 340/961
6,160,497 A 12/2000 Clark
6,271,768 B1 * 8/2001 Frazier, Jr. ..... G08G 5/0008 340/961
6,469,660 B1 * 10/2002 Horvath ..... G01S 7/06 340/961

(Continued)

OTHER PUBLICATIONS

EP Extended Search Report for Application EP 15172215.4 Dated Feb. 17, 2016.

(Continued)

*Primary Examiner* — Thomas G Black
*Assistant Examiner* — Ana Thomas
(74) *Attorney, Agent, or Firm* — Lorenz & Kopf, LLP

(57) ABSTRACT

A method for providing an aircraft display includes the steps of receiving an indication of a current position and altitude of the aircraft, receiving air traffic information for another aircraft within a predetermined range of the current position of the aircraft, and determining whether an element of the traffic information for the another aircraft is missing from the received air traffic information. If an element is missing, the method further includes beginning a timer to determine a length of time that the element is missing. Still further, the method includes the step of, after a predetermined time has elapsed that the element is missing according to the timer, displaying an indication of the another aircraft along with the length of time that the element is missing.

10 Claims, 4 Drawing Sheets

(56) References Cited

U.S. PATENT DOCUMENTS

| | | | | |
|---|---|---|---|---|
| 7,342,514 | B1 * | 3/2008 | Bailey | G01C 23/005 340/961 |
| 7,889,065 | B2 * | 2/2011 | Smith | B60Q 1/34 200/61.27 |
| 8,019,529 | B1 * | 9/2011 | Sharma | G08G 5/06 701/117 |
| 8,478,513 | B1 | 7/2013 | Kar et al. | |
| 8,666,650 | B2 | 3/2014 | Mutuel et al. | |
| 9,082,300 | B2 * | 7/2015 | Scott | G08G 5/0017 |
| 2002/0011950 | A1 * | 1/2002 | Frazier | G01C 23/00 342/357.32 |
| 2003/0233192 | A1 * | 12/2003 | Bayh | G01S 13/765 701/301 |
| 2005/0156777 | A1 * | 7/2005 | King | G01S 3/023 342/29 |
| 2005/0200501 | A1 * | 9/2005 | Smith | G01S 5/06 340/963 |
| 2007/0132638 | A1 * | 6/2007 | Frazier | G01S 13/765 342/455 |
| 2010/0292871 | A1 * | 11/2010 | Schultz | G01C 21/00 701/3 |
| 2011/0118980 | A1 * | 5/2011 | Hoy | G05D 1/0202 701/301 |
| 2012/0191332 | A1 * | 7/2012 | Sawhill | G08G 5/0013 701/120 |
| 2013/0009792 | A1 | 1/2013 | Shafaat | |
| 2013/0176163 | A1 | 7/2013 | Margolin | |
| 2013/3191015 | | 7/2013 | Kar et al. | |
| 2013/0245927 | A1 * | 9/2013 | Kar | G08G 5/0021 701/120 |
| 2014/0210648 | A1 * | 7/2014 | Samuthirapandian | G08G 5/0008 340/961 |

OTHER PUBLICATIONS

Kuchar, J. K. et al.; The Traffic Alert and Collision Avoidance System; vol. 16, No. 2, 2007; Lincoln Laboratory Journal.

* cited by examiner

SYSTEMS AND METHODS FOR DISPLAYING DEGRADED INTRUDER TRAFFIC DATA ON AN AIRCRAFT DISPLAY

TECHNICAL FIELD

The present invention generally relates to display systems and methods for providing displays for situational awareness in an aircraft, and more particularly relates to systems and methods for displaying degraded intruder traffic data on an aircraft display.

BACKGROUND

Air travel has long been, and continues to be, a safe mode of transportation. Nonetheless, substantial effort continues to be expended to develop flight systems and human-factors practices that even further improve aircraft flight safety. Some examples of these flight systems include flight management systems, global navigation satellite systems, differential global positioning systems, air data computers, instrument landing systems, satellite landing systems, traffic alert and collision avoidance systems, weather avoidance systems, thrust management systems, flight control surface systems, and flight control computers, just to name a few.

Despite good flight system design and improved human-factors practices, there is a continuous desire to provide further flight safety improvements. One particular aspect that is presently undergoing significant improvement is in the area of obstacle avoidance. It is generally understood that improving aircraft flight crew situational awareness during flight operations, ground operations, and landing operations, will likely improve the ability of a flight crew to avoid obstacles.

During flight operations, flight crews make every effort to consistently survey the region around the aircraft. However, aircraft structures, such as the wings and the aft lower fuselage, may block large regions of airspace from view. Moreover, at times the cockpit workload can possibly detract the flight crew from visual scanning. To enhance situational awareness during crowded air traffic and/or low visibility flight operations, many aircraft are equipped with a Traffic Alert and Collision Avoidance System (TCAS) and an Automatic Dependent Surveillance-Broadcast System (ADS-B). Although the TCAS/ADS-B does provide significant improvements to situational awareness, the burden remains on the pilots of TCAS-equipped aircraft to avoid another aircraft.

Existing TCAS systems record incoming messages from nearby traffic aircraft received by the ADS-B transponder and assembles these messages into reports. The ADS-B specification in RTCA/DO-242A (Minimum Aviation System Performance Standard) describes the intent elements used for surveillance applications that estimate the flight trajectory of intruder traffic aircraft. The ADS-B mandate requires aircraft to broadcast a state vector only, the target state (TS) intent broadcast is optional, and the trajectory change (TC) message is not included in the mandate. The elements in all the three reports are considered as intent data.

Even after the year 2020 when ADS-B will be mandated on most aircraft, there will be many airspace users that will be not equipped, non-cooperative or non-participating targets. If the host aircraft wants to fly in those areas, it will need a way to track and avoid those non-ADS-B aircraft. With the integration of RADAR target data into the on-board computer and broadcasted ADS-B information available every second, any "data dropouts" (i.e., those aircraft not providing ADS-B information) would be noted as attention items on the ownship flight deck displays.

Hence, there is a need for a system and method of improving aircraft flight crew situational awareness during flight operations. Particularly, there is a need for a system and method for displaying degraded intruder traffic data on an aircraft display. More particularly, there is a need for a system and method to detect and alert the pilot about an aircraft within the specified close range of host aircraft that has its TCAS/ADS-B critical/non-critical intent data dropped over a specified amount of time. The present disclosure addresses at least this need.

BRIEF SUMMARY

Systems and methods for displaying degraded intruder traffic data on an aircraft display are provided. In one embodiment, and by way of example only, a method for providing an aircraft display includes the steps of receiving an indication of a current position and altitude of the aircraft, receiving air traffic information for another aircraft within a predetermined range of the current position of the aircraft, and determining whether an element of the traffic information for the another aircraft is missing from the received air traffic information. If an element is missing, the method further includes beginning a timer to determine a length of time that the element is missing. Still further, the method includes the step of, after a predetermined time has elapsed that the element is missing according to the timer, displaying an indication of the another aircraft along with the length of time that the element is missing.

Furthermore, other desirable features and characteristics of the enhanced situational awareness system and method will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
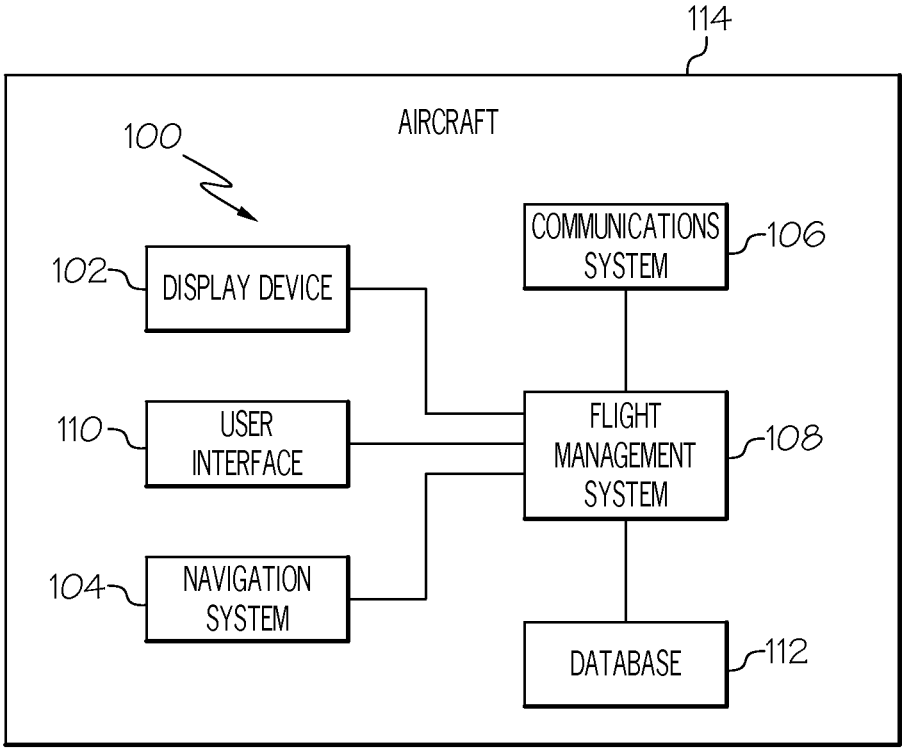
FIG. 1 is a block diagram of a display system suitable for use in an aircraft in accordance with one embodiment.

The following detailed description is merely exemplary in nature and is not intended to limit the invention or the application and uses of the invention. Furthermore, there is no intention to be bound by any theory presented in the preceding background or the following detailed description.

Techniques and technologies may be described herein in terms of functional and/or logical block components, and with reference to symbolic representations of operations, processing tasks, and functions that may be performed by various computing components or devices. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

For the sake of brevity, conventional techniques related to graphics and image processing, navigation, flight planning, aircraft controls, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

The embodiments provided in this disclosure relate to systems and methods for displaying degraded intruder traffic data on an aircraft. As initially note above, despite the requirement for ADS-B on most aircraft in the coming years, there will be many airspace users that will be not equipped, non-cooperative, or non-participating targets. With the coming integration of RADAR target data into the on-board computer and broadcast ADS-B information available every second, any so-called "data dropouts" would be noted as attention items on the ownship flight deck displays. The presently described embodiments allow for the detection and alerting of aircraft within a specified close range of the host aircraft that has had its TCAS/ADS-B critical/non-critical intent data dropped (i.e., missing or non-transmitted) over a specified amount of time, possibly due to having its TCAS/ADS-B broken or which has been deliberately turned off.

The ADS-B specification in RTCA/DO-242A (Minimum Aviation System Performance Standard) describes the content of the various reports used for surveillance applications as State Vector (SV), Target State (TS) and Trajectory change report (TC) State. The FAA mandate for ADS-B Out requires aircraft to broadcast a state vector only, the TS intent broadcast is optional, and the TC message is not included in the mandate. The State Vector information is broadcast every second and includes altitude, aircraft number, vertical airspeed, horizontal, and vertical velocity relative to the ground, which are considered to be critical for locating the state and direction of target aircraft in flight.

By displaying the time over which the particular critical/non-critical intent data, which happens to be critical for the particular phase of flight, is missing or "dropped" for a particular intruder aircraft, and by translating the critical/non-critical intent element data to determine the target track and define a protected zone, the present disclosure assures the pilot of the required safety to maintain the safe separation in the controlled flight environment. With the future ADS-B usage in controlled flights, pilots may be altering their own flight paths without the intervention of air traffic controllers. The display of time information and the commands received from the host traffic computer on the ownship flight deck displays helps the pilot take decisions on maintaining the separation autonomously, without the having the air traffic controller's guidance for maintaining the required separation.

Accordingly, the present disclosure provides a system that calculates the amount of time elapsed for one or more critical/non-critical intent elements that is considered to be critical during the phase of flight, and that has the data dropout over a specified amount of time, for an intruder aircraft within a specified horizontal and vertical range of the host aircraft, as reported by the on-board TCAS/ADS-B. The calculation is carried out by monitoring the time information when the data lapse ("drop") has started. If the elapsed time for one or more critical/non-critical intent elements of a target aircraft reaches or approaches reaching a predetermined time threshold and has a potential conflict with the host, it is alerted to the pilot, with time information, where the time display gives the information of when the data lapse has occurred and when the lapse has reached beyond the specified amount of time. Displaying the intent element with time stamps for an intruder within the range is used to determine the target track and define a protected zone from an intruder aircraft having the degraded data and would help the pilot maintain the required separation from an intruder aircraft that has the mismatch in the data received as reported by on-board TCAS/ADS-B without intervention of the air traffic controller.

In the event of a data lapse, an alerting system displays the time information of a target aircraft, if one or more critical/non-critical intent element having data drop over a predetermined period of time, and has significant effect on creating a potential conflict with the host aircraft. This information would help the pilot take critical decisions for maintaining the required separation by determining target track and defining a protected zone from an intruder having the degraded data thereby resolving them autonomously without the intervention of air traffic controllers.

The exemplary aircraft display system outlined above may be embodied in accordance with the display system illustrated in FIG. 1. In particular, FIG. 1 depicts an exemplary embodiment of a display system 100, which may be located onboard an aircraft 114. This embodiment of display system 100 may include, without limitation, a display device 102, a navigation system 104, a communications system 106, and a flight management system 108 (FMS). The display system 100 further includes a user interface 110 for enabling interactivity with the display system 100 and a database 112 suitably configured to support operation of the display system 100, as described in greater detail below. It should be understood that FIG. 1 is a simplified representation of a display system 100 for purposes of explanation and ease of description, and FIG. 1 is not intended to limit the application or scope of the subject matter in any way. In practice, the display system 100 and/or aircraft 114 will include numerous other devices and components for providing additional functions and features, as will be appreciated in the art.

In an exemplary embodiment, the display device 102 is coupled to the flight management system 108, and the flight management system 108 is configured to display, render, or otherwise convey one or more graphical representations or images associated with operation of the aircraft 114 on the display device 102, as described in greater detail below. The flight management system 108 is coupled to the navigation system 104 for obtaining real-time data and/or information regarding operation of the aircraft 114 to support operation of the flight management system 108, for example including geographical coordinates, altitude, and airspeed, among others. In an exemplary embodiment, the user interface 110 is coupled to the flight management system 108, and the user interface 110 and the flight management system 108 are configured to allow a user to interact with the display device 102 and other elements of display system 100, as described in greater detail below. The communications system 106 is coupled to the flight management system 108 and configured to support communications between the aircraft 114 and another aircraft or ground location (e.g., air traffic control), as will be appreciated in the art.

In an exemplary embodiment, the display device 102 is realized as an electronic display configured to graphically display flight information or other data associated with operation of the aircraft 114 under control of the flight management system 108, as will be understood. In an exemplary embodiment, the display device 102 is located within a cockpit of the aircraft 114. It will be appreciated that although FIG. 1 shows a single display device 102, in practice, additional display devices may be present onboard the aircraft 114. The user interface 110 may also be located within the cockpit of the aircraft 114 and adapted to allow a user (e.g., pilot, co-pilot, or crew member) to interact with the flight management system 108, as described in greater detail below. In various embodiments, the user interface 110 may be realized as a keypad, touchpad, keyboard, mouse, touchscreen, joystick, microphone, or another suitable device adapted to receive input from a user. In an exemplary embodiment, the user interface 110 and flight management system 108 are cooperatively configured to enable a user to indicate, select, or otherwise manipulate one or more pop-up menus displayed on the display device 102, as described below. It should be appreciated that although FIG. 1 shows the display device 102 and user interface 110 within the aircraft 114, in practice, either or both may be located outside the aircraft 114 (e.g., on the ground as part of an air traffic control center or another command center) and communicatively coupled to the flight management system 108.

In an exemplary embodiment, the navigation system 104 is configured to obtain one or more navigational parameters associated with operation of the aircraft 114. The navigation system 104 may be realized as a global positioning system (GPS), inertial reference system (IRS), or a radio-based navigation system (e.g., VHF omni-directional radio range (VOR) or long range aid to navigation (LORAN)), and may include one or more navigational radios or other sensors suitably configured to support operation of the navigation system 104, as will be appreciated in the art. In an exemplary embodiment, the navigation system 104 is capable of obtaining and/or determining the current location of the aircraft 114 (e.g., with reference to a standardized geographical coordinate system) and the heading of the aircraft 114 (i.e., the direction the aircraft is traveling in relative to some reference) and providing these navigational parameters to the flight management system 108.

In an exemplary embodiment, the communications system 106 is configured to support communications between the aircraft 114 and another aircraft or ground location (e.g., air traffic control). In this regard, the communications system 106 may be realized using a radio communication system or another suitable data link system. In accordance with one embodiment, the communications system 106 includes at least one radio configured to be tuned for an identified radio communication frequency, as will be appreciated in the art and described in greater detail below.

In an exemplary embodiment, the flight management system 108 (or, alternatively, a flight management computer) is located onboard the aircraft 114. Although FIG. 1 is a simplified representation of display system 100, in practice, the flight management system 108 may be coupled to one or more additional modules or components as necessary to support navigation, flight planning, and other aircraft control functions in a conventional manner. In addition, the flight management system 108 may include or otherwise access a terrain database, navigational database, geopolitical database, or other information for rendering a navigational map or other content on the display device 102, as described below. In this regard, the navigational map may be based on one or more sectional charts, topographic maps, digital maps, or any other suitable commercial or military database or map, as will be appreciated in the art.

In an exemplary embodiment, the flight management system 108 accesses or includes a database 112 that contains procedure information for a plurality of airports. As used herein, procedure information should be understood as a set of operating parameters or instructions associated with a particular action (e.g., landing, take off, taxiing) that may be undertaken by the aircraft 114 at a particular airport. In this regard, an airport should be understood as referring to a location suitable for landing (or arrival) and/or takeoff (or departure) of an aircraft, such as, for example, airports, runways, landing strips, and other suitable landing and/or departure locations. The database 112 maintains the association of the procedure information and the corresponding airport. In an exemplary embodiment, the procedure information maintained in the database 112 includes instrument procedure information conventionally displayed on a published chart (or approach plate) for the airport, as will be appreciated in the art. In this regard, the procedure information may comprise instrument approach procedures, standard terminal arrival routes, instrument departure procedures, standard instrument departure routes, obstacle departure procedures, or other suitable instrument procedure information. Although the subject matter is described below in the context of an instrument approach procedure for purposes of explanation, in practice, the subject matter is not intended to be limited to instrument approach procedure and may be implemented for instrument departure procedures and other procedures in a similar manner as described below.

Figure 2:
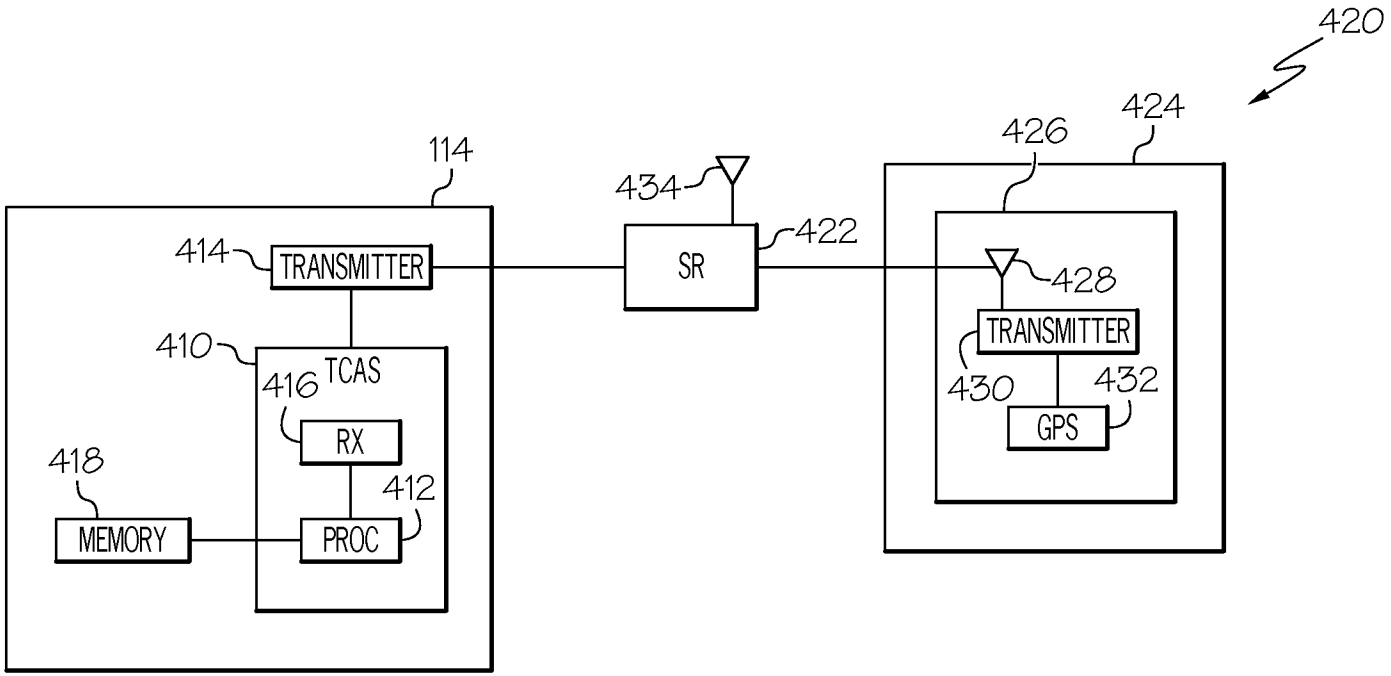
FIG. 2 is a block diagram of a air traffic monitoring system suitable for use in an aircraft in accordance with one embodiment, and provided as part of the navigation system shown in FIG. 1.

FIG. 2 provides greater detail regarding additional features of the navigation system 104 introduced above in the discussion of FIG. 1. FIG. 2 illustrates a schematic view of an example air traffic monitoring system 420. In one embodiment, the system 420 includes a TCAS system 410 aboard the host aircraft 114 that includes a processor 412, a transmitter 414, and a receiver 416. The transmitter 414 generates an interrogation signal based upon surveillance alerts, such as approaching aircraft and threat potentials, produced by a surveillance radar 422. The surveillance radar 422 transmits TCAS transmitter 414 interrogation signals and receives replies at a receiving device 434. A target aircraft 424 includes a surveillance system 426 that receives the interrogation signal at a transmitter receiving device 428 and when interrogated generates a standard transponder reply signal via a transmitter 430. The target aircraft 424 surveillance system 426 may also send an ADS-B reply signal via a navigational component such as a global positioning system (GPS) 432, whenever ADS-B data is available.

ADS-B data provides automatic or autopilot capabilities (i.e., it is always on and requires no operator intervention) and uses accurate position and velocity data from aircraft navigation systems, including latitude and longitude measurements. ADS-B broadcasts aircraft position, altitude, velocity and other data that can be used by air traffic control and other aircraft to share the aircraft's position and altitude.

Whenever the system 420 is not broadcasting, it is listening for Mode-S squitters and reply transmissions at the same frequency used by Mode-S transponders to reply to interrogation signals. Mode-S is a combined secondary surveillance radar and a ground-air-ground data link system which provides aircraft surveillance and communication necessary to support automated air traffic control in dense air traffic environments. Once per second, the Mode-S transponder spontaneously and pseudo-randomly transmits (squits) an unsolicited broadcast. Whenever the Mode-S is not broadcasting, it is monitoring or listening for transmissions. Thus, a TCAS equipped aircraft can see other aircraft carrying a transponder. Once a transponder equipped target has been seen, the target is tracked and a threat potential is determined Altitude information is essential in determining a target's threat potential. Comparison between the altitude information encoded in the reply transmission from the target aircraft 424 and the host aircraft 114 is made in the processor 412 and the pilot is directed to obtain a safe altitude separation by descending, ascending or maintaining current altitude.

Knowledge of the direction, or bearing, of the target aircraft 424 relative to the host aircraft 114 greatly enhances the pilot's ability to visually acquire the threat aircraft and provides a better spatial perspective of the threat aircraft relative to the host aircraft. The processor 412 can display bearing information if it is available. Bearing information is also used by the processor 412 to determine threat potential presented by an intruder aircraft.

The system 420 determines relative bearing by sending the interrogation signal to the target aircraft 424 and listening for replies that return from the target aircraft 424. The reply from the target aircraft 424 may include a standard transponder reply and an ADS-B reply signal. The standard transponder reply gives an estimated bearing by measuring the multi-path interference from the target aircraft 424, including phase and amplitude measurements, speed direction, and altitude. The ADS-B reply signal includes the more accurate bearing measurements of latitude and longitude. When the target aircraft 424 has generated replies to the TCAS 410 interrogation signal, the standard transponder reply and/or the ADS-B reply signal is received by the TCAS receiver 416 and stored in a memory device 418 coupled to the processor 412. The memory device 418 collects varying signals and stores them in an internal database for later use by the processor 412 in determining bearing when ADS-B data is unavailable.

Algorithms within the processor 412 use the relationships between estimated bearing based on standard transponder replies versus bearing computed from ADS-B signals to generate a table or other multi-dimensional expression of the database of information stored in the memory 418. Further, the processor 412 corrects values between the standard transponder reply and ADS-B reply signals to more accurately determine bearing, including averaging the standard transponder reply values and ADS-B values and associating the ADS-B values to previously stored standard transponder reply values.

Figure 3:
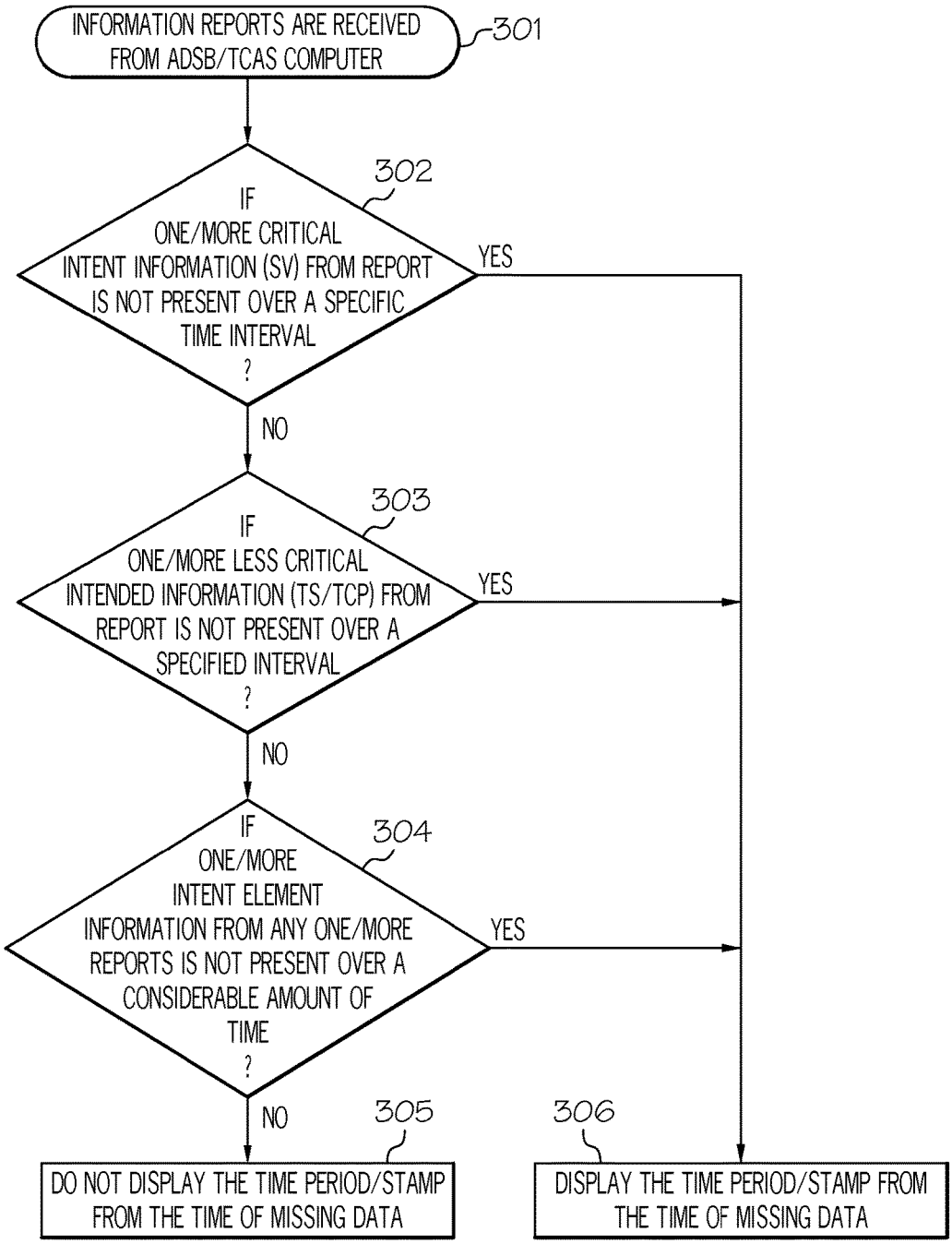
FIG. 3 depicts an exemplary process, in flowchart form, that may be implemented by the system of FIGS. 1 and 2.

FIG. 3 depicts an exemplary process, in flowchart form, that may be implemented by the system of FIGS. 1 and 2. The system and methods presented herein provide information to the flight crew for purposes of optimizing or otherwise enhancing the operation of controlled flights in the safe environment. In particular, the process 300 shown in FIG. 3 begins with a step 301 of receiving TCAS/ADS-B information from the TCAS receiver as illustrated and described above with regard to FIG. 2. Then, the TCAS/ADS-B information is analyzed to determine if one or more critical/non-critical information elements is missing from the TCAS/ADS-B information, as shown with regard to step 302. If information is missing, then a timer begins to determine how long the information has remained missing or lapsed. Once the timer reaches a predetermined threshold, then the information is determined to have lapsed for the predetermined period of time, and the method proceeds to step 306, wherein the time period/stamp from the time of the missing information is displayed on the display device 102. If the predetermined period of time has not been met, then the process proceeds to step 303, wherein it is determined if one or more less critical intended information elements is not present over the specified time interval. If the determination is made in the positive, i.e. that the less critical information is missing and the predetermined time period has elapsed, then the method proceeds to step 306, as described above. If the predetermined period of time has not been met, then the process proceeds to step 304, wherein it is determined if one or more intent element information from any one or more reports is not present over another predetermined period of time. If the determination is made in the positive, i.e. that the time criteria is met, then the process proceeds to step 306, as described above. If however the predetermined period of time is not met, then the time period/stamp form the time of missing data is not displayed on the display device 102.

Figure 4:
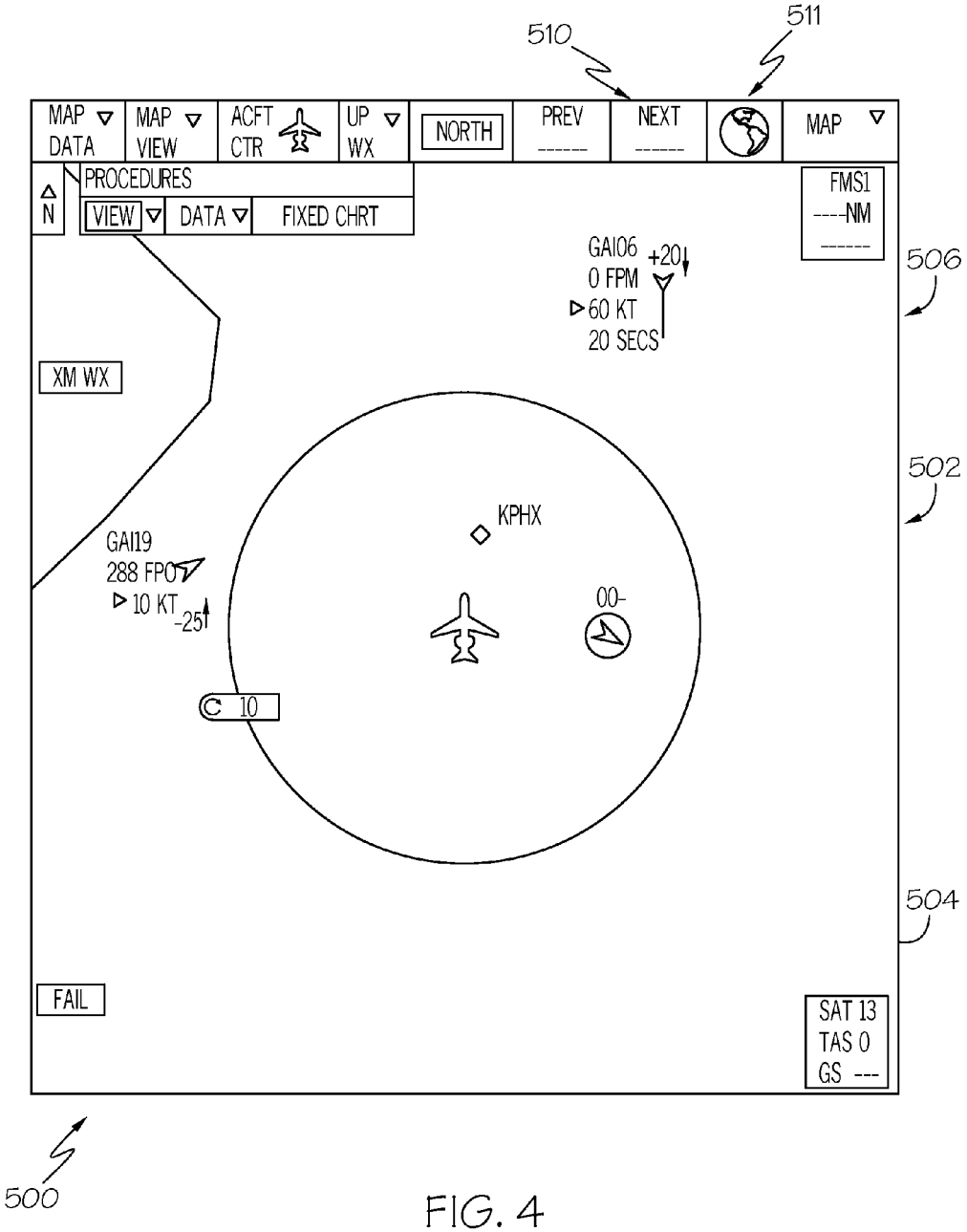
FIG. 4 depicts an exemplary aircraft display that displays degraded intruder traffic data in accordance with the exemplary embodiments depicted in FIGS. 1-3.

In an exemplary embodiment, and with further reference to FIG. 4, a display as described above with regard to step 306 is provided on a navigational map 500 (or terrain map) on the display device 102. For example, the aircraft procedure display process 300 may display and/or render a navigational map 500 associated with a current (or instantaneous) location of an aircraft on a display device in the aircraft. In this regard, the flight management system 108 may be configured to control the rendering of the navigational map 500, which may be graphically displayed on the display device 102. The flight management system may also be configured to render a graphical representation of the aircraft 502 on the map 500, which may be overlaid or rendered on top of a background 504. The background 504 may be a graphical representation of the terrain, topology, or other suitable items or points of interest corresponding to (or within a given distance of) a location of the aircraft 114, which may be maintained by the flight management system 108 in a terrain database, a navigational database, a geopolitical database, or another suitable database. As described in greater detail below, the flight management system 108 may also render a graphical representation of an airport 506 overlying the background 504. It should be appreciated that although the subject matter may be described herein in the context of a navigational map, the subject matter is not intended to be limited to a particular type of content displayed on the display device and the aircraft procedure display process 300 may be implemented with other types of content, such as, for example, an airport map or terminal map.

As further shown in FIG. 4, the map 500 includes an intruder aircraft 510 in a upper right corner of the display. The intruder aircraft 510 includes a time stamp indication 511 of "20 seconds," which indicates that the predetermined period of time of at least 20 seconds has lapsed for which the intruder 510 has one or more critical/non-critical intent element data having been dropped out. Thus, the pilot is provided with a visual cue regarding the intruder for which complete information is missing.

As noted above, based on this displayed information, the system triggers the alerting system and displays the time information of a target aircraft, if one or more critical/non-critical intent element having data drop over a considerable period of time and has significant effect on creating a potential conflict with the host aircraft. This information would help the pilot take critical decisions for maintaining the required separation by determining target track and defining a protected zone from an intruder having the degraded data thereby resolving them autonomously without the intervention of air traffic controllers.

In further aspects of the present disclosure, the described system and method triggers the alerting of the time information for an intruder aircraft, which is within the limited range or has entered the specified horizontal and vertical range of the host aircraft, and is be based on the following information: 1. number of intent elements in the report that has data dropout; 2. time for which the dropping has reached beyond the considerable time level for one or more intent element; 3. criticality of the intent element in the report that has the data dropout; and 4. alerting of the time with various display attributes like fonts, color, blinking and boxing based on the time elapsed for an intruder. The alerting of time information may include a graphical indicator or message that represents the time data. Still further, the disclosed systems and method may display all the intent element data with time stamps (the time information of when the data dropping has started and when the elapsed time for a data drop reaches or approaching to reach the desired safety level) at which the dropouts in data has occurred as a separate info page with menu or dialog boxes that show up when the cursor is placed on the intruder that is showing the time information.

Accordingly, with ongoing separation assurance, research, and FAA NextGen design decisions for the sharing of trajectory intent information, this disclosure enhances the airworthiness standards and allows the host to rely on the usage of the ADS-B data, with detailed traffic information on the flight deck for conflicts within a given time horizon, the aircrew can successfully identify potential trajectory conflicts with other aircraft and make course changes to resolve them autonomously, doing so without active supervision or control by a ground service. The described embodiments may have great industrial applicability as RTCA Special committee 228 is developing minimum performance standards for detect and avoid systems and will strongly consider the enhanced usage of ADS-B functionality which provides surveillance information to avoid collisions with other aircraft. The workload of ground crew in guiding and maintaining the self separation of two controlled aircrafts can be significantly reduced with the available detailed traffic information on the ownship flight deck displays.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for providing an aircraft display comprising the steps of:

receiving an indication of a current position and altitude of the aircraft;

receiving air traffic information for another aircraft in the form of an automatic dependent surveillance-broadcast (ADS-B) within a predetermined range of the current position of the aircraft;

determining whether an intent element of the air traffic information for the another aircraft is missing from the received air traffic information, wherein the intent element is any of a state vector (SV), a target state (TS), or a trajectory change (TC);

if an intent element is missing, beginning a timer to determine a length of time that the intent element is missing;

after a predetermined time has elapsed that the element is missing according to the timer, displaying an indication of the another aircraft along with the length of time that the intent element is missing.

2. The method of claim 1, wherein receiving the indication of the current position and altitude is received from sensors onboard the aircraft.

3. The method of claim 1, wherein receiving air traffic information comprises receiving TCAS/ADS-B information.

4. The method of claim 1, further comprising displaying the indication of the another aircraft and the length of time as a separate information page of the display.

5. The method of claim 4, further comprising displaying the separate information page upon the placement of a cursor over the another aircraft indication on the display.

6. The method of claim 1, wherein the manner of display of the length of time depends on the length of time.

7. The method of claim 1, wherein the element of the air traffic information is a critical element.

8. The method of claim 1, wherein the element of the air traffic information is a non-critical element.

9. The method of claim 1, further comprising displaying the aircraft on the display.

10. The method of claim 9, further comprising displaying the indication of the current position and altitude of the aircraft on the display.

* * * * *